US005907266A

United States Patent [19]

Budka et al.

[11] Patent Number: 5,907,266

[45] Date of Patent: May 25, 1999

[54] ALIGNMENT TOLERANT OVERLAY DIRECTIONAL COUPLER

[75] Inventors: Thomas P. Budka, Plano; Robert A. Flynt, Jr., Dallas, both of Tex.

[73] Assignee: Raytheon Company, Lexington, Mass.

[21] Appl. No.: 08/960,323

[22] Filed: Oct. 29, 1997

Related U.S. Application Data

[60] Provisional application No. 60/031,614, Nov. 26, 1996.

[51] Int. Cl.[6] ..... H01P 5/18

[52] U.S. Cl. ..... 333/116; 333/238

[58] Field of Search ..... 333/116, 204, 333/238

[56] References Cited

U.S. PATENT DOCUMENTS

| | | | |
|---|---|---|---|
| 2,810,892 | 10/1957 | Blitz . | |
| 3,575,674 | 4/1971 | Howe, Jr. | 333/116 |
| 3,617,952 | 11/1971 | Beech . | |
| 5,594,393 | 1/1997 | Bischof | 333/238 X |

FOREIGN PATENT DOCUMENTS 1253898 11/1971 United Kingdom .

OTHER PUBLICATIONS

Siegl, "Design and Optimization of Planar Directional Couplers", 15th European Microwave Conference–Proceedings, Sep. 9–13, 1985, Paris (FR), pp. 853–858.

*Primary Examiner*—Paul Gensler

*Attorney, Agent, or Firm*—Baker & Botts, L.L.P.

[57] ABSTRACT

A directional coupler designed to operate in a predetermined frequency range which includes a first electrical conductor of predetermined length and width, a second electrical conductor having the same length as the first electrical conductor, which is narrower than the first electrical conductor and fully underlies or overlies the first conductor. A dielectric is disposed between the first and second conductors. The width of the first electrical conductor is selected to be 2Δ1 wider than the second electrical conductor, where Δ1 is wider than the layer to layer alignment tolerance of the fabrication process being used. The length of each conductor is less than $\gamma/8\epsilon_r^{1/2}$, where γ is the free space wavelength at the designed frequency of the coupler. The coupler can further include a slot disposed within the first electrical conductor for reduced coupling values. The above described coupler can be cascaded with narrow conductors coupled to wide conductors and vice versa. By cascading pairs of coupled lines with opposite orientations, the reflection coefficients are maintained nearly identical at all ports and the coupling values are the same as long as the coupled line sections meet certain dimensional limitations.

40 Claims, 1 Drawing Sheet

1
3
5
7
9
11

13
15
17
19
21

4

31
33
35
37
39
41
53
55

43
45
47
49
51

8

ALIGNMENT TOLERANT OVERLAY DIRECTIONAL COUPLER

CROSS REFERENCE TO RELATED APPLICATIONS

This application claims priority under 35 USC § 119 of provisional application Ser. No. 60/031,614, filed Nov. 26 1996.

BACKGROUND OF THE INVENTION

1. Field of the Invention

This invention relates to directional couplers and, more specifically, to a directional coupler which has substantial immunity to misalignments.

2. Brief Description of the Prior Art

A directional coupler is a four port device which receives power through one port and divides the power between two other ports with the fourth port being isolated and receiving very little power due to cancellation of signals within the coupler. The coupling may be weak or strong wherein, in the case of weak coupling, for example, perhaps only ten percent of the power received will be sent to the coupled port whereas in the case of strong coupling, for example perhaps fifty percent (3 dB) of the received power will be sent to the coupled port.

Directional couplers can be fabricated in many types of embodiments, one such type of embodiment being as a part of a multilayer printed wiring board (PWB) or multilayer ceramic thin film network (TFN). In the fabrication of directional couplers as part of a multilayer PWB, the fabrication tolerances for a state of the art process are typically about ±0.002 inch (3 sigma) for layer to layer registration of metal patterns. For high frequency applications, for example 1 to 100 GHz, and for thermal considerations, the dielectric layers for a multi-layer PWB or TFN are maintained thin and in the range of from about 0.001 inch to about 0.005 inch. For this range of thicknesses, interlayer registration is critical to yielding highly repeatable directional coupler designs.

For a stripline structure with two centered metal layers between two ground planes, the directional coupler of choice for high values (3 dB) is a broad-side coupled directional coupler. The sensitivity of the particular design to dimensions and layer to layer registration increases with higher coupling values. Couplers of this type generally comprise a pair of closely spaced apart electrically conductive elements which may have a width of about 4 to 6 mils, which are spaced apart by about 1 mil and which have a length of less than $\gamma/4\epsilon_r^{1/2}$ where $\gamma$ is the free space wavelength at the stripline design frequency for the coupler and $\epsilon_r$ is the effective dielectric constant of the coupler dielectric. It can be seen that such couplers which are misaligned by ±0.002 inch and which are designed to provide 3 dB of coupling will provide instead about 4.5 dB of coupling. Such errors often cannot be tolerated. Accordingly, an improved directional coupler structure in conjunction with PWBs which is less sensitive to misalignment is highly desirable.

SUMMARY OF THE INVENTION

In accordance with the present invention, there is provided a directional coupler in conjunction with PWBs and the like of the above described type which is substantially immune to errors due to misalignment within a large fabrication window. The directional coupler in accordance with the present invention significantly reduces the sensitivity of the coupling value with respect to layer to layer registration.

Briefly, the standard cell in accordance with the present invention includes two lines, with a first line having a width W1 and a second line separated from the first line by a dielectric and having the same length and a wider line width, W2, with the wider line fully underlying or overlying the narrower line. Generally, plural such cells are cascaded with each line having a first section of width w1 and a second section of equal length of width w2. The coupler is designed so that a line section of width w1 of the first line fully overlies a section of width w2 of the second line and a section of width w2 of the second line fully underlies a section of width w1 of the first line. The length of one of the conductors is extended at least the length of the expected alignment tolerance, Δ1, on each end to account for misalignment along the axis of the conductor. The width of the wider line, w2, is selected to be 2Δ1 wider than the narrower line, w1, where Δ1 is at least wider than the layer to layer alignment tolerance of the fabrication process being used. The line widths are selected for a particular coupling value since the capacitance between spaced apart lines is a function of line areas overlying each other. As a second embodiment, a slot may be added in the center region of the wider line, w2, to reduce the odd mode capacitance (or line to line capacitance) and further reduce the coupling value. The two lines are separated by a thin dielectric layer. Though only a pair of standard cells of the type described are shown as being cascaded with alternate wide and narrow line segments to provide the final directional coupler, it should be understood that such cascading can be continued in the same manner as described above. More extensive designs may also vary the cell to cell structure to achieve broader bandwidth or a desired cutoff response. The directional coupler is generally a part of a printed wiring board structure and includes ground planes on both sides of the cell and spaced from the cell by a dielectric layer on both sides of the cell.

By making one of the transmission lines wider, the sensitivity of the odd-mode capacitive coupling with respect to the layer to layer registration is significantly reduced. Coupled lines with identical line widths are more sensitive to layer to layer registration than is the case of the present invention. By cascading pairs of coupled lines with opposite orientations, the reflection coefficients are maintained identical at all ports and the coupling values are the same as long as the coupled line sections are maintained to be less than $\gamma/8\epsilon_r^{1/2}$ with the total length of each cascaded pair of individual cells adding up to, for example, less than or equal to $\gamma/4\epsilon_r^{1/2}$, where $\gamma$ is the free space wavelength at the design frequency of the coupler and $\epsilon_r$ is the relative dielectric constant of the dielectric between the coupler elements and the ground planes.

In the event that the longitudinal alignment becomes a problem, the length of the narrow strip can be increased by Δ1. This is to prevent the coupling from increasing due to an overlap of the wider lengths of transmission lines. The coupling due to these short lengths of line is negligible compared to the main coupling sections, so lateral misalignment of these sections will not significantly affect the performance of the overall circuit.

Commonly used (prior art) directional couplers are broadside coupled line directional couplers that use the same line width for each line. Edge coupled line directional couplers, which usually suffer from low coupling values, require narrow gaps and are very sensitive to narrow gaps between coupled lines to achieve high coupling values. The prior art Lange Coupler requires lines and gaps that are too narrow for repeatable fabrication using printed wiring board technology. Line widths and gaps are not pushed to the limit by the design in accordance with the present invention.

It follows that a directional coupler fabricated in accordance with the present invention is alignment insensitive within a large window compared to conventional prior art designs and provides a self-compensating coupling. Due to the symmetric structure, return loss, coupling value and isolation are the same for all ports.

DESCRIPTION OF THE PREFERRED EMBODIMENTS

Figures 1, 2, 3, 4, 5, 6, 7, 8:
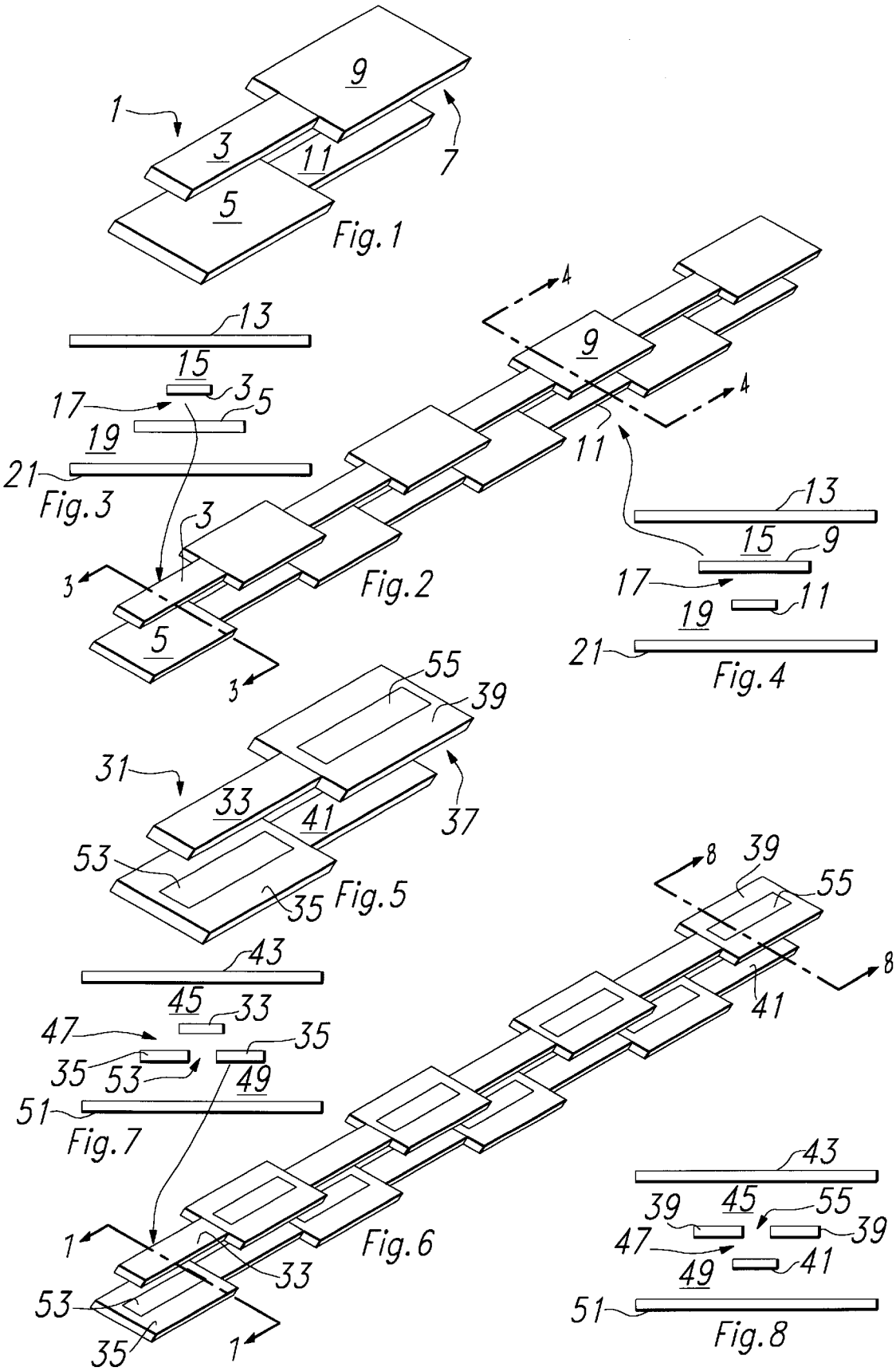
FIG. 1 is a perspective view of a pair of cascaded coupler elements in accordance with a first embodiment of the present invention with ground planes and dielectric between the coupler and ground planes omitted.
FIG. 2 is a perspective view of a coupler as in FIG. 1 utilizing a plurality of pairs of cascaded coupler elements of the type shown in FIG. 1.
FIG. 3 is a cross sectional view taken along the line 3—3 of FIG. 2 with ground planes and dielectric between the ground planes and coupler included.
FIG. 4 is a cross sectional view taken along the line 4—4 of FIG. 2 with ground planes and dielectric between the ground planes and coupler included.
FIG. 5 is a perspective view of a pair of cascaded coupler elements in accordance with a second embodiment of the present invention with ground planes and dielectric between the coupler and ground planes omitted.
FIG. 6 is a perspective view of a coupler as in FIG. 5 utilizing a plurality of pairs of cascaded coupler elements of the type shown in FIG. 5.
FIG. 7 is a cross sectional view taken along the line 7—7 of FIG. 6 with ground planes and dielectric between the ground planes and coupler included.
FIG. 8 is a cross sectional view taken along the line 8—8 of FIG. 6 with ground planes and dielectric between the ground planes and coupler included.

Referring first to FIG. 1, there is shown a pair of cascaded coupler elements in accordance with a first embodiment of the present invention with the ground planes and dielectric between the ground planes and coupler omitted. A first coupler element 1 is formed of electrically conductive material, preferably copper, and includes a narrow conductor 3 and a wide conductor 5 of equal length with the narrow conductor fully overlying or underlying the wide conductor and spaced from the wide conductor by an intervening dielectric (not numbered). A second coupler element 7 is shown which is identical to the first coupler element except for the reversal of the narrow and wide lines and is cascaded with the first coupler element and includes a wide conductor 9 connected to the narrow conductor 3 and a narrow conductor 11 connected to the wide conductor 5. Referring to FIG. 2, there is shown a coupler which includes a plurality of coupler element pairs of the type described in FIG. 1 in cascaded relationship. As can be seen in FIG. 3, the coupler is part of a four level PWB and includes ground plane 13 spaced from the narrow conductor 3 by a dielectric region 15. The narrow conductor 3 is spaced from the wide conductor 5 by a dielectric region 17 which can be a different dielectric from the dielectric 15 and the wide conductor 5 is spaced from the ground plane 21 by a dielectric region 19. As can be seen in FIG. 4, the coupler is still part of the same four level PWB and includes ground plane 13 spaced from the wide conductor 9 by the dielectric region 15. The wide conductor 9 is spaced from the narrow conductor 11 by the dielectric region 17 and the narrow conductor 11 is spaced from the ground plane 21 by the dielectric region 19. The dielectric regions can have the same or different dielectrics.

Referring now to FIG. 5, there is shown a second embodiment of the invention which is similar to the first embodiment except that each wide conductor includes a slot therein. The second embodiment includes a pair of cascaded coupler elements with the ground planes and dielectric between the ground planes and coupler omitted. A first coupler element 31 is formed of electrically conductive material, preferably copper, and includes a narrow conductor 33 and a wide conductor 35 of equal length with the narrow conductor fully overlying or underlying the wide conductor and spaced from the wide conductor by an intervening dielectric (not numbered). A second coupler element 37 is shown which is identical to the first coupler element except for the reversal of the narrow and wide lines and is cascaded with the first coupler element and includes a wide conductor 39 connected to the narrow conductor 33 and a narrow conductor 41 connected to the wide conductor 35. Each of the wide conductors 35 and 41 includes a slot 53 and 55 respectively as shown in FIG. 5 to reduce the odd mode capacitance and further reduce the coupling value. Referring to FIG. 6, there is shown a coupler which includes a plurality of coupler element pairs of the type described in FIG. 5 in cascaded relationship. As can be seen in FIG. 7, the coupler is part of a four level PWB and includes ground plane 43 spaced from the narrow conductor 3 by a dielectric region 45. The narrow conductor 33 is spaced from the wide conductor 35 by a dielectric region 47 and the wide conductor 35 is spaced from the ground plane 51 by a dielectric region 49. As can be seen in FIG. 8, the coupler is still part of the same four level PWB and includes ground plane 43 spaced from the wide conductor 39 by the dielectric region 45. The wide conductor 39 is spaced from the narrow conductor 41 by the dielectric region 47 and the narrow conductor 41 is spaced from the ground plane 51 by the dielectric region 49.

Though the invention has been described with reference to specific preferred embodiments thereof, many variations and modifications will immediately become apparent to those skilled in the art. It is therefore the intention that the appended claims be interpreted as broadly as possible in view of the prior art to include all such variations and modifications.

We claim:

1. An apparatus comprising a directional coupler which is operable in a predetermined frequency range, said coupler including:

an electrical first conductor extending in a direction, and having first and second portions disposed therealong adjacent each other, said first and second portions respectively having first and second lengths in said direction, and respectively having first and second widths, said first width being greater than said second width; and an electrical second conductor spaced from said first conductor, extending in said direction, and having third and fourth portions disposed therealong adjacent each other, said third portion having a third length which is approximately the same as said first length and said fourth portion having a fourth length which is approximately the same as said second length, said third and fourth portions respectively being aligned in said direction with said first and second portions, and respectively having third and fourth widths, said third width being less than said first width, and said fourth width being greater than each of said second and third widths, said first and second conductors being electrically separate but electromagnetically coupled.

2. The coupler of claim 1, wherein said third length is greater than said first length by at least 2Δ1, and said second length is greater than said fourth length by at least 2Δ1, where Δ1 is a layer to layer misalignment tolerance.

3. The coupler of claim 1, wherein said first width is at least 2Δ1 greater than said third width, and said fourth width is at least 2Δ1 greater than said second width, where Δ1 is a layer to layer misalignment tolerance.

4. The coupler of claim 1, including a dielectric material disposed between said first and second conductors; and wherein said first, second, third and fourth lengths are each less than or equal to $\gamma/8\epsilon_r^{1/2}$ where γ is a free space wavelength at a design frequency of the coupler and $\epsilon_r$ is an effective dielectric constant of said dielectric material.

5. The coupler of claim 1, further including a slot disposed within each of said first and fourth portions.

6. The coupler of claim 5 wherein said second and third portions are each slotless.

7. An apparatus according to claim 1, including a dielectric material disposed between said first and second conductors.

8. An apparatus according to claim 1, including a ground plane extending parallel to said direction and spaced from each of said first and second conductors, one of said first and second conductors being disposed between said ground plane and the other of said first and second conductors.

9. An apparatus according to claim 1, including first and second ground planes which extend parallel to each other and parallel to said direction, said ground planes each being spaced from each of said first and second conductors, said first and second conductors being disposed between said ground planes, and said first conductor being between said first ground plane and said second conductor.

10. An apparatus according to claim 9, including a first dielectric portion disposed between said first ground plane and said first conductor, a second dielectric portion disposed between said second ground plane and said second conductor, and a third dielectric portion disposed between said first and second conductors.

11. An apparatus according to claim 10, wherein each of said first and fourth portions has a slot therein.

12. A directional coupler designed to operate in a predetermined frequency range which comprises:

(a) a first electrical conductor of predetermined length and width;

(b) a second electrical conductor of a predetermined length, said second electrical conductor being narrower than said first electrical conductor and fully underlying said first electrical conductor, said first and second electrical conductors being electromagnetically coupled;

(c) a third electrical conductor having substantially the same length and width as said second electrical conductor and being directly connected to said first electrical conductor;

(d) a fourth electrical conductor having substantially the same length and width as said first electrical conductor and being directly connected to said second electrical conductor, said third electrical conductor fully overlying said fourth electrical conductor, said third and fourth electrical conductors being electromagnetically coupled; and (e) a dielectric disposed between said first and second electrical conductors, and disposed between said third and fourth electrical conductors.

13. The coupler of claim 12 wherein the lengths of said first and fourth electrical conductors are respectively the same as the lengths of said second and third electrical conductors plus at least 2Δ1, where Δ1 is a layer to layer misalignment tolerance.

14. The coupler of claim 13 wherein the lengths of said first, second, third and fourth electrical conductors are each less than or equal to $\gamma/8\epsilon_r^{1/2}$ with the total length of said first and third electrical conductors and the total length of said second and fourth electrical conductors each being less than or equal to $\gamma/4\epsilon_r^{1/2}$, where γ is a free space wavelength at a design frequency of the coupler and $\epsilon_r$ is an effective dielectric constant of said dielectric.

15. The coupler of claim 13 wherein said first electrical conductor and said fourth electrical conductor each have a slot therein.

16. The coupler of claim 15 wherein said second and third electrical conductors are each slotless.

17. The coupler of claim 12 wherein the widths of said first and fourth electrical conductors are at least 2Δ1 greater than the widths of said second and third electrical conductors, respectively, where Δ1 is a layer to layer misalignment tolerance.

18. The coupler of claim 17 wherein the lengths of said first, second, third and fourth electrical conductors are each less than or equal to $\gamma/8\epsilon_r^{1/2}$ with the total length of said first and third electrical conductors and the total length of said second and fourth electrical conductors each being less than or equal to $\gamma/4\epsilon_r^{1/2}$, where γ is a free space wavelength at a design frequency of the coupler and $\epsilon_r$ is an effective dielectric constant of said dielectric.

19. The coupler of claim 18 wherein said first electrical conductor and said fourth electrical conductor each have a slot therein.

20. The coupler of claim 19 wherein said second and third electrical conductors are each slotless.

21. The coupler of claim 12 wherein the lengths of said first, second, third and fourth electrical conductors are each less than or equal to $\gamma/8\epsilon_r^{1/2}$ with the total length of said first and third electrical conductors and the total length of said second and fourth electrical conductors each being less than or equal to $\gamma/4\epsilon_r^{1/2}$, where γ is a free space wavelength at a design frequency of the coupler and $\epsilon_r$ is an effective dielectric constant of said dielectric.

22. The coupler of claim 21 wherein said first electrical conductor and said fourth electrical conductor each have a slot therein.

23. The coupler of claim 22 wherein said second and third electrical conductors are each slotless.

24. The coupler of claim 12 wherein said first electrical conductor and said fourth electrical conductor each have a slot therein.

25. The coupler of claim 24 wherein said second and third electrical conductors are each slotless.

26. The coupler of claim 12, including two parallel, spaced ground planes, said first, second, third and fourth electrical conductors being disposed between and being spaced from said ground planes.

27. A directional coupler designed to operate in a predetermined frequency range which comprises:

(a) a first electrical conductor of predetermined length and width;

(b) a second electrical conductor of a predetermined length, said second electrical conductor being narrower than said first electrical conductor and fully underlying said first electrical conductor, said first and second electrical conductors being electromagnetically coupled;

(c) a third electrical conductor having substantially the same length and width as said second electrical conductor and being directly connected to said first electrical conductor;

(d) a fourth electrical conductor having substantially the same length and width as said first electrical conductor and being directly connected to said second electrical conductor, said third electrical conductor fully overlying said fourth electrical conductor, and said third and fourth electrical conductors being electromagnetically coupled;

(e) a fifth electrical conductor having substantially the same length and width as said first electrical conductor and being directly connected to said third electrical conductor at an end thereof remote from said first electrical conductor;

(f) a sixth electrical conductor having substantially the same length and width as said second electrical conductor and being directly connected to said fourth conductor at an end thereof remote from said second electrical conductor, said fifth and sixth electrical conductors being electromagnetically coupled; and (g) a dielectric disposed between said first and second electrical conductors, between said third and fourth electrical conductors, and between said fifth and sixth electrical conductors.

28. The coupler of claim 27 wherein the lengths of said first and fourth electrical conductors are respectively the same as the length of said second and third electrical conductors plus at least $2\Delta 1$, where $\Delta 1$ is a layer to layer misalignment tolerance.

29. The coupler of claim 28 wherein the length of said first, second, third, fourth, fifth and sixth electrical conductors are each less than or equal to $\gamma/8\epsilon_r^{1/2}$ with the total length of said first and third electrical conductors, the total length of said second and fourth electrical conductors, the total length of said third and fifth electrical conductors, and the total length of said fourth and sixth electrical conductors each being less than or equal to $\gamma/4\epsilon_r^{1/2}$, where $\gamma$ is a free space wavelength at a design frequency of the coupler and $\epsilon_r$ is an effective dielectric constant of said dielectric.

30. The coupler of claim 28 wherein each of said first electrical conductor, said fourth electrical conductor and said fifth electrical conductor has a slot therein.

31. The coupler of claim 30 wherein said second, third and sixth electrical conductors are each slotless.

32. The coupler of claim 27 wherein the widths of said first and fourth electrical conductors are at least $2\Delta 1$ greater than the widths of said second and third electrical conductors, respectively, where $\Delta 1$ is a layer to layer misalignment tolerance.

33. The coupler of claim 32 wherein the lengths of said first, second, third, fourth, fifth and sixth electrical conductors are each less than or equal to $\gamma/8\epsilon_r^{1/2}$ with the total length of said first and third electrical conductors, the total length of said second and fourth electrical conductors, the total length of said third and fifth electrical conductors, and the total length of said fourth and sixth electrical conductors each being less than or equal to $\gamma/4\epsilon_r^{1/2}$, where $\gamma$ is a free space wavelength at a design frequency of the coupler and $\epsilon_r$ is an effective dielectric constant of said dielectric.

34. The coupler of claim 33 wherein each of said first electrical conductor, said fourth electrical conductor and said fifth electrical conductor has a slot therein.

35. The coupler of claim 34 wherein said second, third and sixth electrical conductors are each slotless.

36. The coupler of claim 27 wherein the lengths of said first, second, third, fourth, fifth and sixth electrical conductors are each less than or equal to $\gamma/8\epsilon_r^{1/2}$ with the total length of said first and third electrical conductors, the total length of said second and fourth electrical conductors, the total length of said third and fifth electrical conductors, and the total length of said fourth and sixth electrical conductors each being less than or equal to $\gamma/4\epsilon_r^{1/2}$, where $\gamma$ is a free space wavelength at a design frequency of the coupler and $\epsilon_r$ is an effective dielectric constant of said dielectric.

37. The coupler of claim 36 wherein each of said first electrical conductor, said fourth electrical conductor and said fifth electrical conductor has a slot therein.

38. The coupler of claim 37 wherein said second, third and sixth electrical conductors are each slotless.

39. The coupler of claim 27 wherein each of said first electrical conductor, said fourth electrical conductor and said fifth electrical conductor has a slot therein.

40. The coupler of claim 39 wherein said second, third and sixth electrical conductors are each slotless.

* * * * *

UNITED STATES PATENT AND TRADEMARK OFFICE

CERTIFICATE OF CORRECTION

PATENT NO. : 5,907,266

DATED : May 25, 1999

INVENTOR(S) : Thomas P. Budka and Robert A. Flynt, Jr.

It is certified that error appears in the above-identified patent and that said Letters Patent is hereby corrected as shown below:

Title page, [57], Col. 2, line 12, after "than" delete "γ" and insert --λ--.
Title page, [57], Col. 2, line 12, after "where" delete "γ" and insert --λ--.
Col. 1, line 50, after "than" delete "γ" and insert --λ--.
Col. 1, line 50, after "where" delete "γ" and insert --λ--.
Col. 2, line 46, delete "γ" and insert --λ--.
Col. 2, line 48, after "to" delete "γ" and insert --λ--.
Col. 2, line 48, after "where" delete "γ" and insert --λ--.
Col. 5, line 17, after "to" delete "γ" and insert --λ--.
Col. 5, line 17, after "where" delete "γ" and insert --λ--.
Col. 6, line 11, after "to" delete "γ" and insert --λ--.
Col. 6, line 14, after "to" delete "γ" and insert --λ--.
Col. 6, line 14, after "where" delete "γ" and insert --λ--.
Col. 6, line 29, after "to" delete "γ" and insert --λ--.
Col. 6, line 32, after "to" delete "γ" and insert --λ--.
Col. 6, line 32, after "where" delete "γ" and insert --λ--.
Col. 6, line 41, after "to" delete "γ" and insert --λ--.
Col. 6, line 44, after "to" delete "γ" and insert --λ--.
Col. 6, line 44, after "where" delete "γ" and insert --λ--.
Col. 7, line 34, after "the" delete "length" and insert --lengths--.
Col. 7, line 37, after the second 'the" delete "length" and insert --lengths--.
Col. 7, line 39, after "to" delete "γ" and insert --λ--.
Col. 7, line 44, after "to" delete "γ" and insert --λ--.
Col. 7, line 44, after "where" delete "γ" and insert --λ--.

UNITED STATES PATENT AND TRADEMARK OFFICE

CERTIFICATE OF CORRECTION

PATENT NO. : 5,907,266

DATED : May 25, 1999

INVENTOR(S) : Thomas P. Budka and Robert A. Flynt, Jr.

It is certified that error appears in the above-identified patent and that said Letters Patent is hereby corrected as shown below:

Col. 8, line 13, after "to" delete "γ" and insert --λ--.
Col. 8, line 18, after "to" delete "γ" and insert --λ--.
Col. 8, line 18, after "where" delete "γ" and insert --λ--.
Col. 8, line 27, after "to" delete "γ" and insert --λ--.
Col. 8, line 32, after "to" delete "γ" and insert --λ--.
Col. 8, line 32, after "where" delete "γ" and insert --λ--.

Signed and Sealed this

Tenth Day of April, 2001

*Attest:*

Nicholas P. Godici

NICHOLAS P. GODICI

*Attesting Officer*

*Acting Director of the United States Patent and Trademark Office*